US012616343B2

(12) United States Patent
Tiejun et al.

(10) Patent No.: US 12,616,343 B2
(45) Date of Patent: May 5, 2026

(54) DRYING DEVICE, FIXED SEAT ASSEMBLY AND TOILET

(71) Applicant: LIXIL Living Technology (SuZhou) Corporation, Suzhou (CN)

(72) Inventors: Ni Tiejun, Suzhou (CN); Yan Peihua, Suzhou (CN); Huang Ying, Suzhou (CN); Dai Zhiqiang, Suzhou (CN); Zhu Jing, Suzhou (CN); Masayuki Makino, Suzhou (CN)

(73) Assignee: LIXIL Living Technology (SuZhou) Corporation, Xushuguan (CN)

( * ) Notice: Subject to any disclaimer, the term of this patent is extended or adjusted under 35 U.S.C. 154(b) by 1035 days.

(21) Appl. No.: 17/694,038

(22) Filed: Mar. 14, 2022

(65) Prior Publication Data

US 2022/0296052 A1 Sep. 22, 2022

(30) Foreign Application Priority Data

Mar. 17, 2021 (CN) ..... 202120549092.4

(51) Int. Cl.
*A47K 10/48* (2006.01)

(52) U.S. Cl.
CPC ..... *A47K 10/48* (2013.01)

(58) Field of Classification Search
CPC ..... A47K 10/48; A45D 20/08; A45D 20/10; A45D 20/12; A45D 20/122
See application file for complete search history.

(56) References Cited

U.S. PATENT DOCUMENTS

| | | | | |
|---|---|---|---|---|
| 8,066,017 | B1 * | 11/2011 | Born | A45D 20/12 132/271 |
| 9,930,950 | B1 * | 4/2018 | Cage | A45D 20/12 |
| 10,722,017 | B1 * | 7/2020 | Abehasera | A45D 20/124 |
| 2014/0047727 | A1 * | 2/2014 | Torres | A45D 19/16 34/97 |
| 2017/0114530 | A1 * | 4/2017 | Lee | E03D 9/08 |

FOREIGN PATENT DOCUMENTS

| | | | | |
|---|---|---|---|---|
| KR | 20090101744 A | * | 9/2009 | E03D 9/08 |
| KR | 2011011884 | * | 2/2011 | A47K 10/48 |

* cited by examiner

*Primary Examiner* — David J Laux
(74) *Attorney, Agent, or Firm* — Tyler A. Stevenson; Anna-lisa L. Gallo

(57) ABSTRACT

A drying device, a fixed seat assembly and a toilet. The drying device includes a housing, provided with an air inlet and an air outlet; a fan, positioned inside the housing and adjacent to the air inlet; a heater, located inside the housing and adjacent to the air outlet; and an air bucket, disposed at the air outlet. The air bucket is capable of reducing the risk of water or dirt entering the air outlet, thus being helpful in protecting the heater.

14 Claims, 5 Drawing Sheets

DRYING DEVICE, FIXED SEAT ASSEMBLY AND TOILET

TECHNICAL FIELD

The utility relates to the technical field of toilet manufacturing, and in particular to a drying device.

BACKGROUND

A toilet is one of the indispensable sanitary wares in modern society. With the development of the toilet manufacturing industry, people have higher and higher requirements for the integration and functionality of the toilet, and the use of the toilet is becoming more and more intelligent.

For hygiene reasons, the existing smart toilets generally have cleaning functions, such as cleaning the hips of users after going to the toilet, and cleaning the ceramic parts of the toilet. In addition to the cleaning functions, the existing smart toilets usually have a warm air drying function, and the users do not need to wipe their hips with paper after going to the toilet, so that the toileting experience is better.

However, the structures of the existing smart toilets still need to be improved.

SUMMARY

The problem to be solved by the utility is to provide a drying device, a fixed seat assembly and a toilet, in order to reduce the risk of water or dirt entering an air outlet, thus being helpful in protecting a heater.

In order to solve the above problem, the utility provides a drying device, including a housing, provided with an air inlet and an air outlet; a fan, positioned inside the housing and adjacent to the air inlet; a heater, located inside the housing and adjacent to the air outlet; and an air bucket, disposed at the air outlet.

Optionally, the air bucket includes a first air duct and a second air duct connected with each other, and the first air duct forms an included angle with the second air duct.

Optionally, the first air duct and the second air duct are smoothly connected with each other by means of rounded corners.

Optionally, the top end of the first air duct is connected with the air outlet, one end of the second air duct is connected with the bottom end of the first air duct, and the other end of the second air duct extends in the direction away from the housing.

Optionally, the included angle between the first air duct and the second air duct is 87°-101°.

Optionally, the included angle between the first air duct and the second air duct is 93°, and the first air duct supplies air in the vertical direction.

Optionally, the length ratio of the first air duct to the second air duct is 2:1.

Optionally, the housing includes an upper housing and a lower upper housing, and the upper housing is detachably connected with the lower housing.

Optionally, the drying device further includes a thermistor, positioned in the air bucket.

Accordingly, the utility also provides a fixed seat assembly, including the drying device and a fixed seat, the housing is disposed on the fixed seat, and the air bucket extends out of the bottom of the fixed seat.

Accordingly, the utility also provides a toilet, including the fixed seat assembly and a toilet body provided with a toilet basin, the fixed seat assembly is disposed on the toilet body, and the air bucket is located at the top edge of the toilet basin.

Compared with the prior art, due to the adoption of the technical solution, the utility has the advantages that:

The drying device includes a housing, a fan, a heater, and an air bucket. The housing is provided with an air inlet and an air outlet. The fan is positioned inside the housing and adjacent to the air inlet, and the rotation of the fan causes air to rush into the air inlet to form air power. The heater is located inside the housing and adjacent to the air outlet, and is used for heating the passing air so as to enable the air outlet to output warm air. The air bucket is disposed at the air outlet, and the water or dirt sprayed to the air outlet is blocked by the air bucket and is therefore difficult to enter the air outlet. Accordingly, the air bucket is capable of reducing the risk of the water or dirt entering the air outlet, thus being helpful in protecting the heater.

DETAILED DESCRIPTION

In order to make the above purposes, characteristics and advantages of the utility more obvious and understandable, the specific embodiments of the utility will be described in detail below with reference to the drawings.

Figure 1:
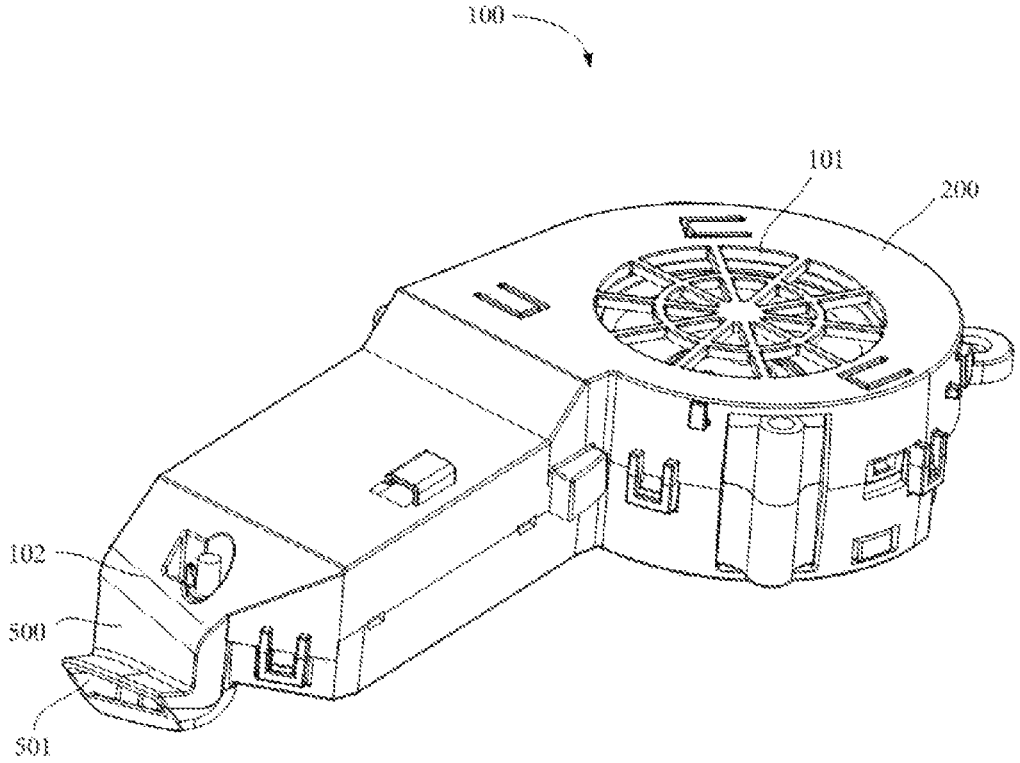
FIG. 1 is a stereoscopic view of a drying device according to one embodiment of the utility.
Figure 2:
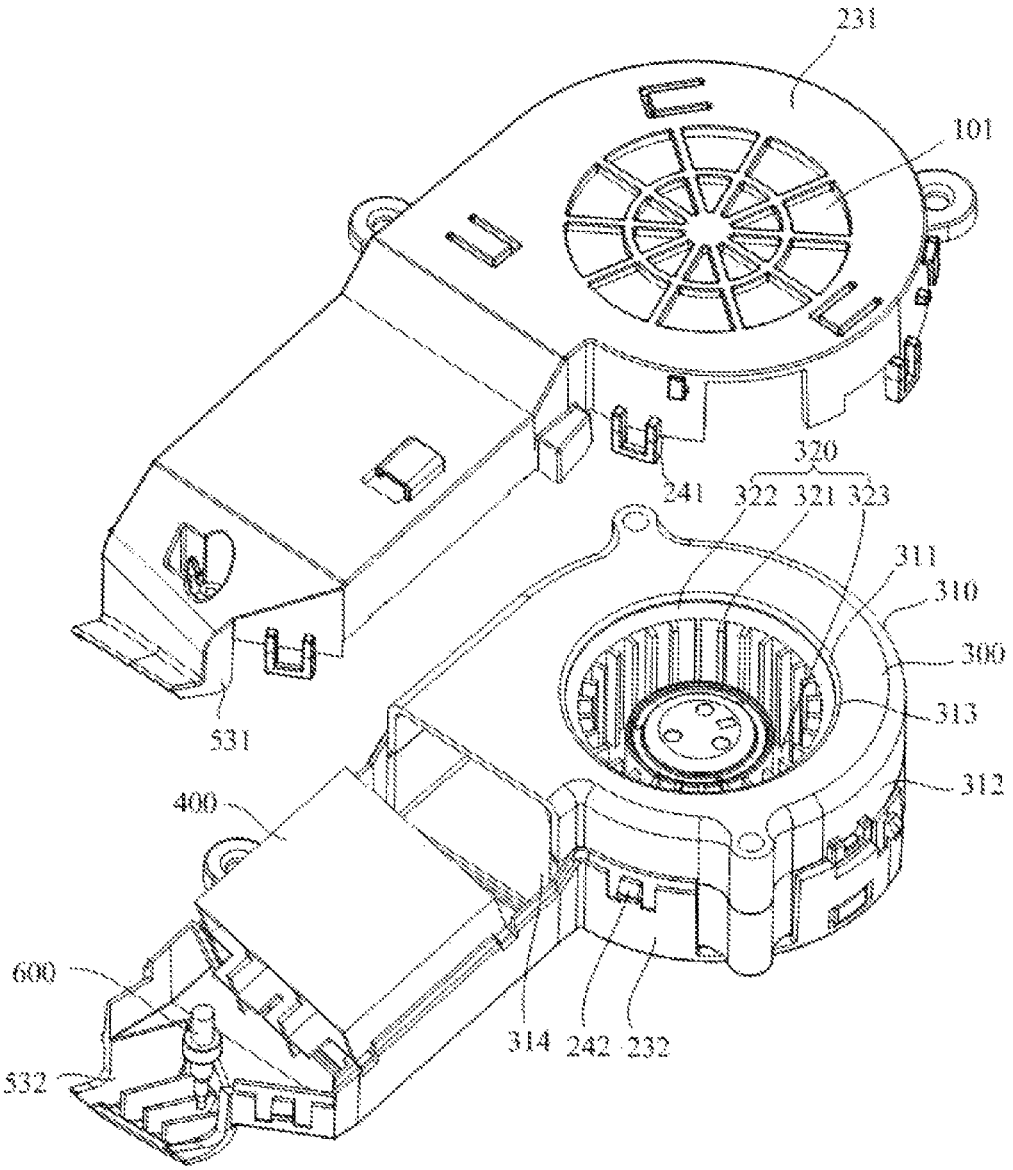
FIG. 2 is an exploded view of the drying device shown in FIG. 1.

Referring to FIG. 1 and FIG. 2, a drying device 100 includes a housing 200, and the housing 200 is provided with an air inlet 101 and an air outlet 102; a fan 300, positioned inside the housing 200 and adjacent to the air inlet 101; a heater 400, located inside the housing 200 and adjacent to the air outlet 102; and an air bucket 500, disposed at the air outlet 102.

Figure 3:
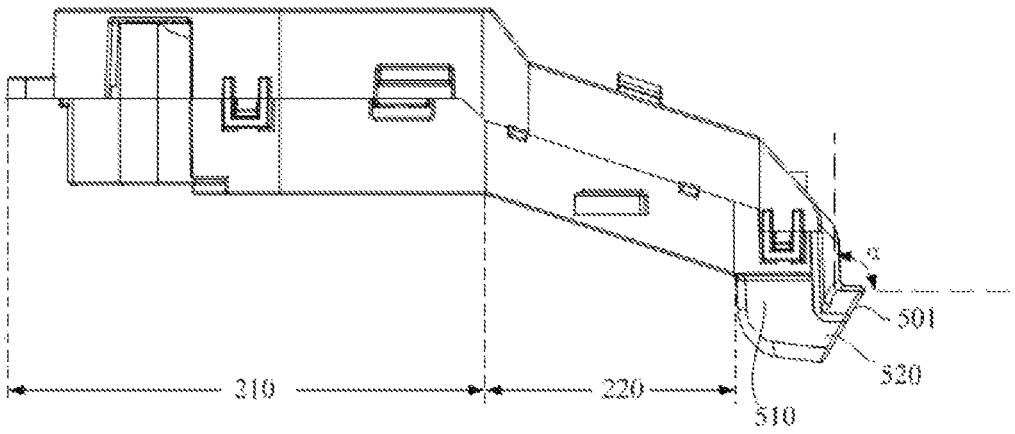
FIG. 3 is a side view of the drying device shown in FIG. 1.

Referring to FIG. 1 and FIG. 3, in the present embodiment, the housing 200 includes a housing body 210 and an air outlet cavity duct 220 connected with each other. The housing body 210 has a hollow cylindrical structure, and the air inlet 101 is located in one of the bottom surfaces of the cylindrical structure. The fan 300 (refer to FIG. 2) is located in the housing body 210.

One end of the air outlet cavity duct 220 is connected with the housing body 210, and the air outlet 102 is located at the other end of the air outlet cavity duct 220. The heater 400 (refer to FIG. 2) is located in the air outlet cavity duct 220.

In the present embodiment, the air outlet cavity duct 220 extends downward obliquely relative to the housing body 210.

Referring to FIG. 2, the fan 300 includes a casing 310 and an impeller part 320. The casing 310 has a cylindrical structure. The casing 310 has an inner side wall 311 and an outer side wall 312. The inner side wall 311 has a cylindrical curved surface, and the cylindrical curved surface is used as the inner surface of a containing chamber 313 of the impeller part 320.

The outer side wall 312 is disposed circumferentially about the inner side wall 311, and an annular inner cavity 314 is defined by the outer side wall 312 and the inner side wall 311. The annular inner cavity 314 is communicated with the air outlet cavity duct 220 (refer to FIG. 3).

The impeller part 320 includes an impeller front disc 322, an impeller rear disc 323, and a plurality of impellers 321 located between the impeller front disc 322 and the impeller rear disc 323. The impeller front disc 322 and the impeller rear disc 323 are disposed opposite to each other, are both in a circular ring shape, and have overlapping central axes. The plurality of impellers 321 are arranged at equal intervals around the central axis.

The rotation of the fan 300 causes air to rush into the air inlet 101 to form air power, and the formed air is conveyed into the air outlet cavity duct 220 (refer to FIG. 3) through the annular inner cavity 314, and the conveyed air is heated by the heat output by the heater 400 when passing through the heater 400 in the air outlet cavity duct 220 (refer to FIG. 3), so that the warm air is formed. The warm air then enters the air bucket 500 (refer to FIG. 1) from the air outlet 102 (refer to FIG. 1) and is discharged through the air bucket 500 (refer to FIG. 1).

Referring to FIG. 1 and FIG. 3, along the conveying direction of warm air in the air bucket 500, the air bucket 500 includes a first air duct 510 and a second air duct 520 connected with each other, and the first air duct 510 forms an included angle α with the second air duct 520.

In the present embodiment, an air duct of the air bucket 500 is formed by the first air duct 510 and the second air duct 520.

The included angle α helps to increase the change of the air duct direction in the air bucket 500 so as to further reduce the risk of the water or dirt in the toilet basin being sputtered into the air outlet 102.

The top end of the first air duct 510 is connected with the air outlet 102, one end of the second air duct 520 is connected with the bottom end of the first air duct 510, and the other end of the second air duct 520 extends in the direction away from the housing 200 as an exhaust outlet 501 of the air bucket 500.

The extension direction of the second air duct 520 can ensure that the warm air discharged from the air bucket 500 is ejected forward relative to the housing 200, thus being convenient for users to dry their hips after going to the toilet.

The included angle α between the first air duct 510 and the second air duct 520 is 87°-101°. The included angle α between the first air duct 510 and the second air duct 520 is appropriate, and this is beneficial to reduce the influence of the included angle α on the warm air speed, ensure the intensity of the warm air discharged from the air bucket 500, and also prevent the water or dirt from entering the air outlet 102, thus further avoiding the influence of the water or dirt permeating the heater 400 on the heating performance of the heater 400.

The included angle α is formed between the extending direction of the first air duct 510 and the extending direction of the second air duct 520.

The included angle α is at least less than or equal to 101°, and this has the effects that: on the premise that the position of the air outlet 102 and the position of the exhaust outlet 501 are fixed, if the included angle α is less than or equal to 101°, the length of the entire air duct formed by the first air duct 510 and the second air duct 520 can be increased, that is, the length of the path required for the water or dirt to reach the air outlet 102 through the air bucket 500 is increased, helping to further reduce the risk of the water or dirt entering the air outlet 102, thus being conducive to protection of the heater 400.

Furthermore, the included angle α is set to be at least greater than or equal to 87° to avoid the excessive weakening, caused by the sharp change of airflow direction, of the warm air speed when the warm air passes through the included angle α that is an acute angle and is too small, thus guaranteeing the intensity of the warm air discharged from the air bucket 500, and further ensuring the drying efficiency.

In the present embodiment, the included angle α between the first air duct 510 and the second air duct 520 is 93°, and the first air duct supplies air in the vertical direction.

The length ratio of the first air duct 510 to the second air duct 520 is 2:1. The length ratio of the first air duct 510 to the second air duct 520 is appropriate, and this is beneficial to increase the intensity of the warm air discharged from the air bucket 500, and ensure the blocking effect of the air bucket 500 on the water or dirt.

In the present embodiment, the first air duct 510 and the second air duct 520 are smoothly connected with each other by means of rounded corners. The rounded corners help to realize the smooth turning of the warm air at the connection, and ensure that the warm air maintains the original air speed or the weakening of the air speed is extremely small, so as to increase the intensity of the warm air discharged from the air bucket 500.

Referring to FIG. 2, the housing 200 includes an upper housing 231 and a lower upper housing 232, and the upper housing 231 is detachably connected with the lower housing 232.

The upper housing 231 is detachably connected with the lower housing 232, and this facilitates replacement or maintenance of the fan 300 or the heater 400.

In the present embodiment, the upper housing 231 and the lower housing 232 are in snap-connection. The upper housing 231 is provided with a plurality of snap rings 241, the lower housing 232 is provided with a plurality of snap blocks 242, and the snap rings 241 are matched with the snap blocks 242.

The air bucket 500 includes a top casing 531 and a bottom casing 532, and the air duct is defined by the top casing 531 and the bottom casing 532.

The top casing 531 is detachably connected with the bottom casing 532.

In the present embodiment, the top casing 531 and the upper housing 231 are integrally formed. The bottom casing 532 and the lower housing 232 are integrally formed.

The drying device 100 also includes a thermistor 600, positioned in the air bucket 500.

The thermistor 600 is used for sensing the temperature of the warm air conveyed in the air bucket 500. The heater 400 is used for adjusting the temperature according to the temperature, detected by the thermistor 600, of the warm air, so as to ensure that the temperature of the warm air discharged from the air bucket 500 is in a suitable range.

The thermistor 600 is disposed in the air bucket 500, and this helps to accurately sense the temperature of the warm air discharged from the air bucket 500, thus improving the timeliness and accuracy of the temperature adjustment performed by the heater 400.

The top casing 531 is detachably connected with the bottom casing 532, and this facilitates replacement or maintenance of the thermistor 600.

Figure 4:
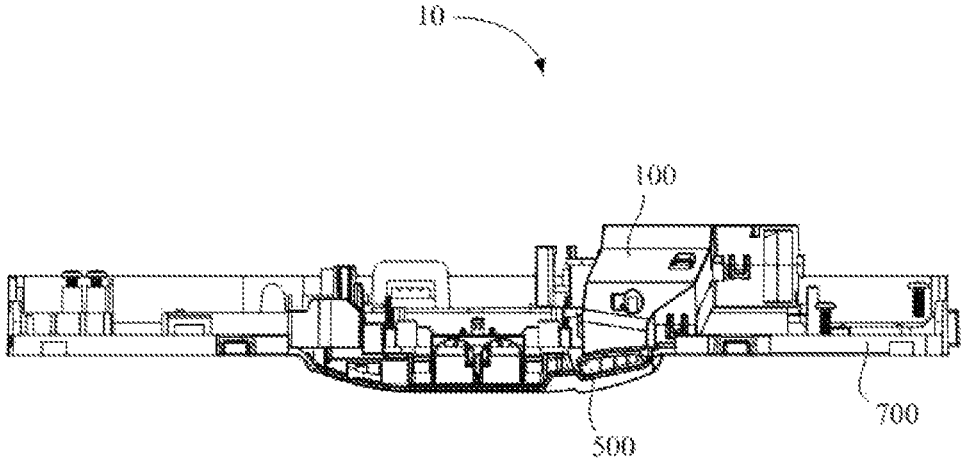
FIG. 4 is a schematic structure diagram of a fixed seat assembly according to one embodiment of the utility.
Figure 5:
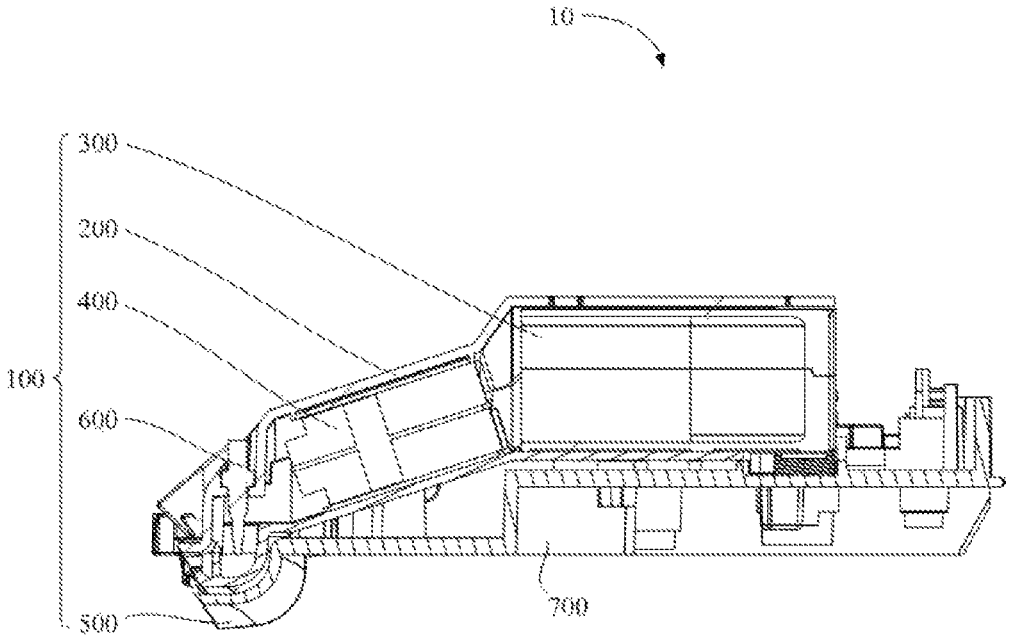
FIG. 5 is a sectional view of the fixed seat assembly shown in FIG. 4.

Referring to FIG. 4 and FIG. 5, the utility also provides a fixed seat assembly 10, including the drying device 100 and a fixed seat 700, the housing 200 is disposed on the fixed seat 700, and the air bucket 500 extends out of the bottom of the fixed seat 700.

The housing 200 is disposed on the fixed seat 700 to enable the fixed seat 700 to support the housing 200, the fan 300 and the heater 400.

The air bucket 500 extends out of the bottom of the fixed seat 700, and this helps to reduce the occupation of the space on the fixed seat 700 by the air bucket 500, thus ensuring the effective utilization of the space on the fixed seat 700.

Figure 6:
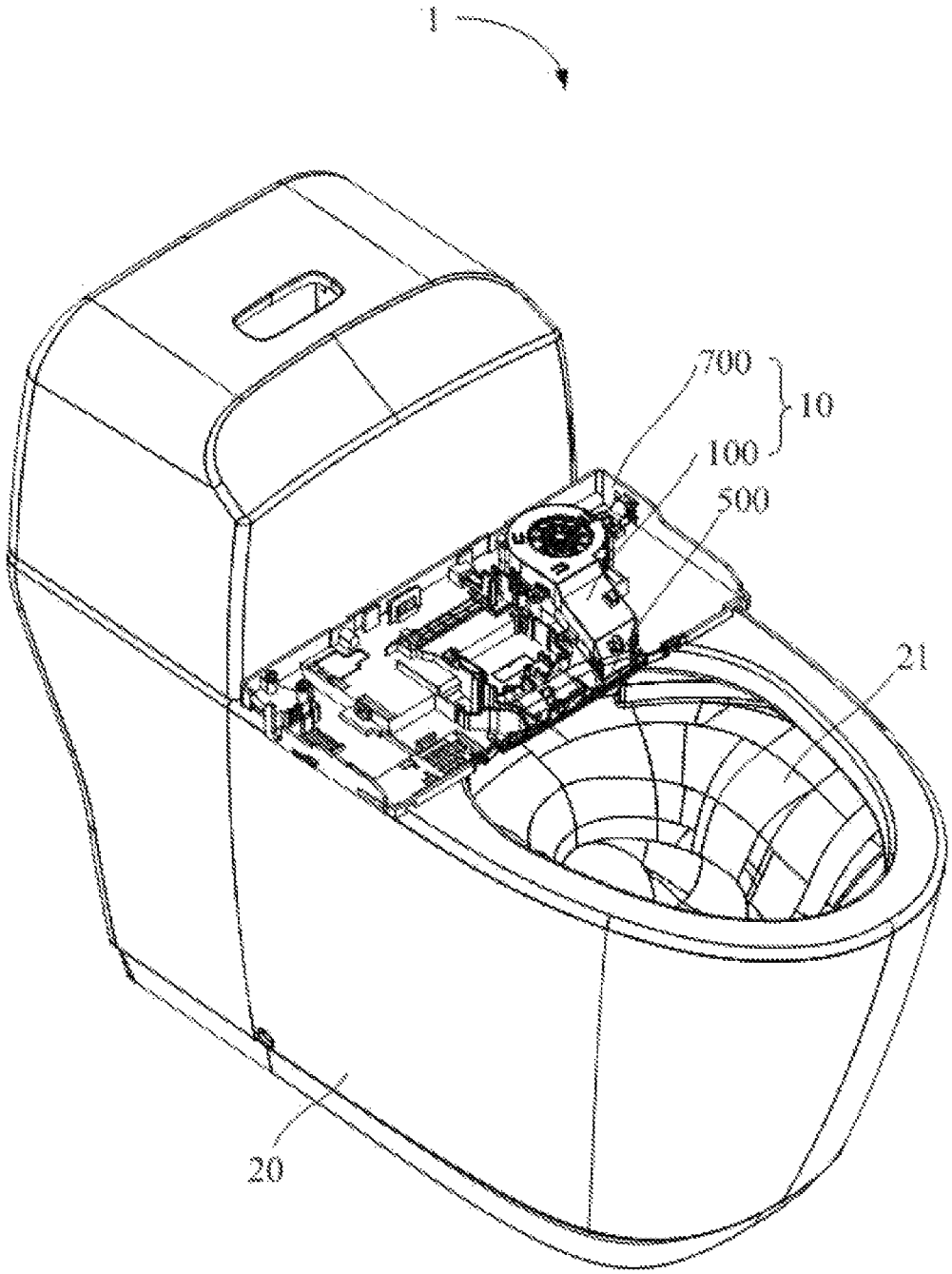
FIG. 6 is a schematic structure diagram of a toilet according to one embodiment of the utility.

Referring to FIG. 6, the utility also provides a toilet 1, including the fixed seat assembly 10 and a toilet body 20, the toilet body 20 is provided with a toilet basin 21, the fixed seat assembly 10 is disposed on the toilet body 20, and the air bucket 500 is located at the top edge of the toilet basin 21.

The warm air discharged from the air bucket 500 is suitable for the users going to the toilet to further dry their hips after washing same. The air bucket 500 is also helpful in reducing the risk of the water or dirt in the toilet basin 21 entering the air outlet 102 (refer to FIG. 1), thus guaranteeing the cleanliness of the heater 400 (refer to FIG. 2); and furthermore, the heating performance of the heater 400 (refer to FIG. 2) is prevented from being affected by the water or dirt entering the heater 400 (refer to FIG. 2), so that the heater 400 (refer to FIG. 2) is protected.

Although the utility is disclosed as above, it is not limited thereto. Any one of those skilled in the art may make various alterations and modifications without departing from the spirit and scope of the utility, so that the protection scope of the utility should be subject to the scope defined by the claims.

The invention claimed is:

1. A drying device for a user of a toilet, comprising a housing comprising a housing body connected to an air outlet cavity duct, the housing provided with a housing air inlet and a housing air outlet;

a fan positioned inside the housing body adjacent to the housing air inlet;

a heater located inside the air outlet cavity duct adjacent to the housing air outlet; and an air bucket disposed at the housing air outlet, wherein the air outlet cavity duct extends downward obliquely from the housing body, and comprises a first end connected to the housing body, and a second end comprising the housing air outlet, the air bucket extends downward and forward from the air outlet cavity duct, and is configured to extend downward towards a toilet basin, and to extend forward towards the user, the air bucket is configured to be positioned at a top edge of the toilet basin, and the air bucket comprises a warm air outlet configured to direct warm air forward towards the user to dry the user after using the toilet.

2. The drying device according to claim 1, wherein the air bucket comprises a first air duct portion connected to a second air duct portion at an included angle, the first air duct portion extends downward, and the second air duct portion extends forward and comprises the warm air outlet, and the included angle is configured to prevent water from entering the housing air outlet to protect the heater.

3. The drying device according to claim 2, wherein the first air duct portion and the second air duct portion are smoothly connected by rounded corners.

4. The drying device according to claim 2, wherein a top end of the first air duct portion is connected with the housing air outlet, a first end of the second air duct portion is connected with a bottom end of the first air duct portion, and a second end of the second air duct portion extends forward and comprises the warm air outlet.

5. The drying device according to claim 4, wherein the included angle is from 87° to 101°.

6. The drying device according to claim 5, wherein the included angle is 93°, and the first air duct portion extends vertically downward.

7. The drying device according to claim 5, wherein the first air duct portion extends downward vertically.

8. The drying device according to claim 4, wherein a length ratio of the first air duct portion to the second air duct portion is 2:1.

9. The drying device according to claim 4, wherein the air bucket extends downward vertically from the housing air outlet.

10. The drying device according to claim 2, wherein the housing is disposed on a fixed seat, the fixed seat is configured to be positioned on a toilet body provided with the toilet basin, and the second air duct portion extends forward from below the fixed seat.

11. A toilet comprising the drying device according to claim 10, wherein the fixed seat is positioned on the toilet body.

12. The drying device according to claim 2, wherein the first air duct portion extends downward vertically.

13. The drying device according to claim 1, wherein the housing comprises an upper housing and a lower housing, and the upper housing is detachably connected with the lower housing.

14. The drying device according to claim 1, comprising a thermistor positioned in the air bucket.

* * * * *